US006089209A

United States Patent [19]

Kouchi et al.

[11] Patent Number: 6,089,209

[45] Date of Patent: Jul. 18, 2000

[54] MOUNTING CONFIGURATION FOR AN ENGINE FUEL LINE

[75] Inventors: Hiroyoshi Kouchi; Shogo Nakamura; Kazuyuki Kobayashi, all of Tokyo, Japan

[73] Assignee: Mitsubishi Heavy Industries, Ltd., Tokyo, Japan

[21] Appl. No.: 09/238,062

[22] Filed: Jan. 27, 1999

[30] Foreign Application Priority Data

Jan. 27, 1998 [JP] Japan ..... 10-29208

[51] Int. Cl.[7] ..... F02B 77/00; F02B 55/02

[52] U.S. Cl. ..... 123/468; 123/198 E

[58] Field of Search ..... 123/468, 469, 123/198 E, 195 C

[56] References Cited

U.S. PATENT DOCUMENTS 4,841,929 7/1996 Tuggle ..... 123/198 E
5,197,426 3/1993 Frangesch ..... 123/198 E
5,533,485 6/1989 Tuggle ..... 123/198 E

FOREIGN PATENT DOCUMENTS 64-47976 U 3/1989 Japan .
3-65827 U 6/1991 Japan .

*Primary Examiner*—Thomas N. Moulis
*Attorney, Agent, or Firm*—Evenson, McKeown, Edwards & Lenahan, P.L.L.C.

[57] ABSTRACT

A configuration for mounting a fuel line on an engine which reduces the number of parts needed to mount the fuel lines and the fuel cock, reduces the number of assembly and mounting processes, and improves both the handling qualities and the safety of the engine at a low cost. In this fuel line configuration for a single-cylinder multi-purpose engine having a fan cover and a front cover on the front of the engine, a fuel tank on top of the engine is connected to the carburetor by a fuel line with a fuel cock on it. Semicircular grooves are provided in the fan cover and front cover, and the fuel line is engaged in a channel formed by the two grooves and thereby immobilized. The fuel cock, which is attached to the front end of the fuel line, is mounted to the front cover.

3 Claims, 6 Drawing Sheets

JAPANESE PUBLICATION OF UTILITY MODEL (PRIOR ART)

MOUNTING CONFIGURATION FOR AN ENGINE FUEL LINE

FIELD OF THE INVENTION

This invention concerns a mounting configuration for the fuel line or pipe in a single-cylinder multi-purpose engine, and more specifically, an engine with a canted cylinder.

BACKGROUND OF THE INVENTION

In small single-cylinder multi-purpose engines (hereinafter simply called "engines"), the fuel tank and the carburetor are usually connected by a fuel line comprising a resin tube.

FIG. 5 is a front view of a canted cylinder-type single cylinder multi-purpose engine belonging to the prior art.

In this figure, 1 is the engine, and 2 is the engine body. Fan cover 3 and recoil starter 4, which is used to start the engine, are mounted on the front surface of the engine body 2. Front cover 11 is mounted above the top of the fan cover 3.

Fuel tank 7 sits atop the engine body 2. Throttle lever 12 is in an aperture in the front cover 11. Air cleaner 5 is mounted on the side of the engine body 2. Muffler cover 6 is fixed to the top of the air cleaner 5.

Fuel line 8 runs from the top of engine body 2 along the front of the engine between the fuel tank 7 and the carburetor (not shown). Part way along the fuel line 8 is a fuel cock 9.

The fuel line 8 runs from the fuel outlet on the bottom of fuel tank 7 through the space between the front cover 11 and the fan cover 3 on the side of the engine body 2 opposite the exhaust outlet. It passes along the front of fan cover 3 and is connected to the carburetor. The fuel line 8 is fixed by clamps 10 to structural parts of the engine such as the engine body 2 and fan cover 3.

In a design proposed in published Japanese Utility Model Showa 64-47976, as shown in FIG. 6, a channel for the fuel hose of a multi-purpose engine is formed by hollowing out a portion of the surface of the cylinder body (i.e., the engine body) on the side of the cooling fan. The fuel hose is then run through the channel.

The mounting configurations of the fuel line and fuel cock according to the prior art designs described above have the following disadvantages.

In the prior art design shown in FIG. 5, fuel line 8 is fixed to engine body 2 by means of clamps 10 where fuel cock 9 is connected to fuel tank 7 and where the cock 9 is connected to the carburetor. This arrangement prevents the fuel from leaking and keeps the fuel line from slipping off the engine. However, the use of clamps 10 and various bolts increases the parts count and the number of assembling processes needed to mount fuel line 8 and cock 9.

With this prior art design, fuel cock 9 also is quite close to starter grip 4*a* on the engine. The cock gets in the way when the user tries to start the engine, and the location of the cock makes it difficult to use the cock as well.

In the design proposed in published Japanese Utility Model Showa 64-47976, as shown in FIG. 6, a groove is formed on the cylinder body (i.e., the engine body) through which the fuel hose is run, and a cover is mounted to enclose the fuel line. This design, too, requires a large number of parts and numerous assembly processes to mount the fuel line.

SUMMARY OF THE INVENTION

In view of the problems inherent in the prior art, the object of this invention was to provide a mounting configuration for the fuel line of an engine which would reduce the number of parts needed to mount the fuel line and fuel cock, reduce the number of assembly and mounting processes required to build the engine, and improve the handling and safety features of the engine at a low cost.

To solve this problem, a first preferred embodiment of this invention comprises a mounting configuration for the fuel line in a single-cylinder multi-purpose engine with a fan cover on the front of the engine and a front cover fixed to the top of the fan cover, in which the fuel tank mounted on top of the engine is connected to the carburetor mounted on the side of the engine by a fuel line with a fuel cock. This configuration is characterized by the fact that there are semicircular grooves in both the fan cover and front cover between which the fuel line is passed.

A second preferred embodiment of the invention has the same configuration as described above, with the addition that the fuel cock is fixed to the front cover, and one end of the fuel line engages the outer periphery of the connector of the fuel cock, and is sandwiched or clamped, and held fast between the groove on the fan cover and the groove on the front cover.

A third preferred embodiment of the invention has the same configuration as described above, with the addition that there is a tooth on the inner periphery of the groove, and the tooth extends through the end of the fuel line and engages a narrowed portion of the connector of the fuel cock in order to immobilize the fuel line.

According to this invention, the fuel line passes through an opening formed by two semicircular grooves, one on the fan cover and the other on the front cover, and the fuel cock is fixed to the front cover. Thus, when it is mounted to the front cover, the position of the fuel line is fixed, and the fuel line is immobilized. There is no need for the clamps and related hardware used in the prior art, and the fuel line can be positioned accurately and attached securely.

Since the fuel cock is fixed to the surface of the front cover, it can be mounted easily. The cock is also easier to operate, so the operability of the engine is improved.

BRIEF DESCRIPTION OF THE DRAWINGS

The invention will be described in further detail hereinafter with reference to illustrative preferred embodiments shown in the accompanying drawings in which.

DETAILED DESCRIPTION OF THE PREFERRED EMBODIMENTS

In this section a preferred embodiment of the invention will be described in detail with reference to the drawings. To the extent that the dimensions, materials, shape and relative position of the components described in this embodiment are not definitely fixed, the scope of the invention is not limited to those specified, which are meant to serve merely as illustrative examples.

Figure 1:
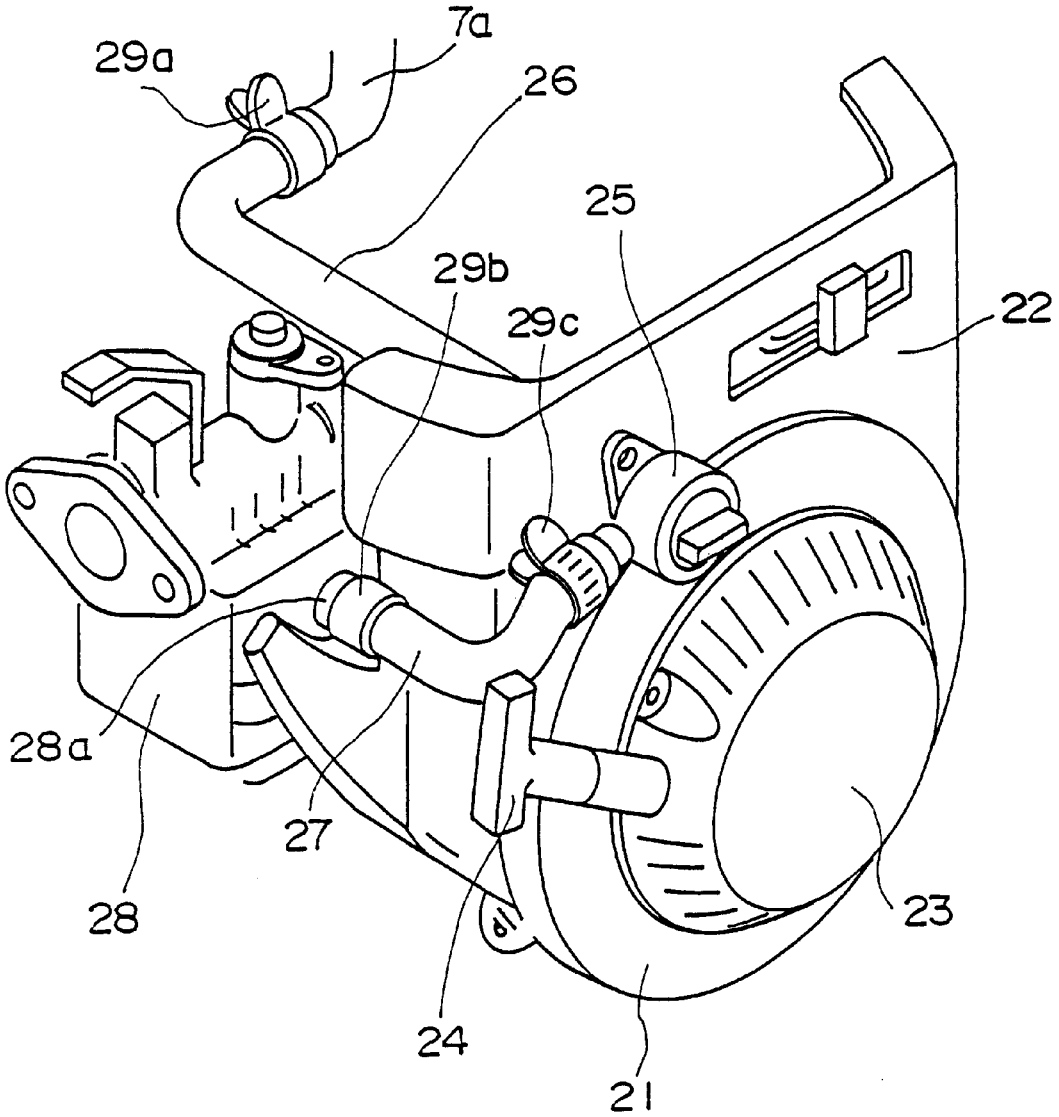
FIG. 1 is a perspective view of a preferred embodiment showing the essential components in the vicinity where the fuel line and front cover are mounted on the front of a small, multi-purpose, canted cylinder-type single-cylinder engine.
Figure 2:
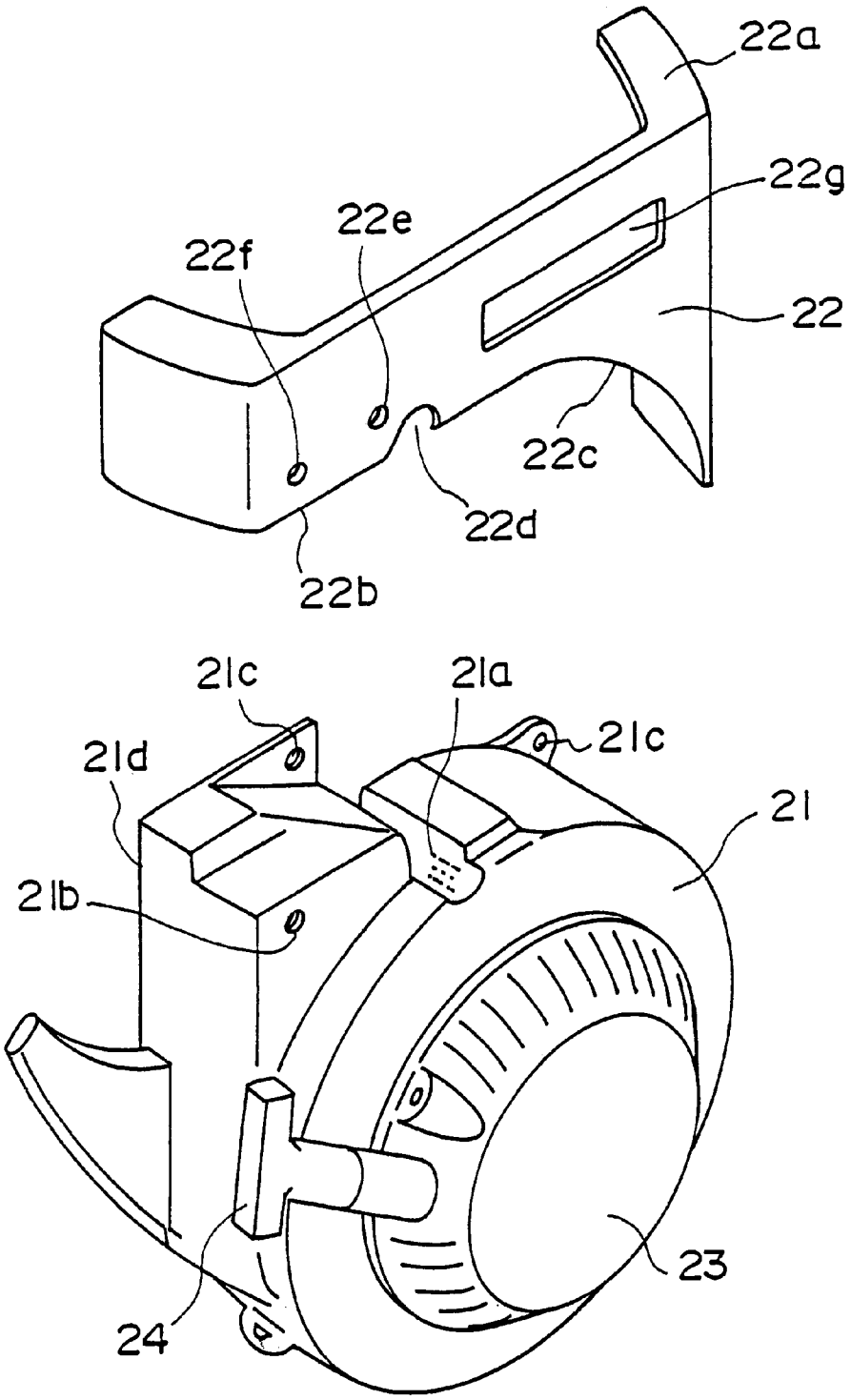
FIG. 2 is a perspective view of the essential parts of the fan cover and front cover.
Figure 3:
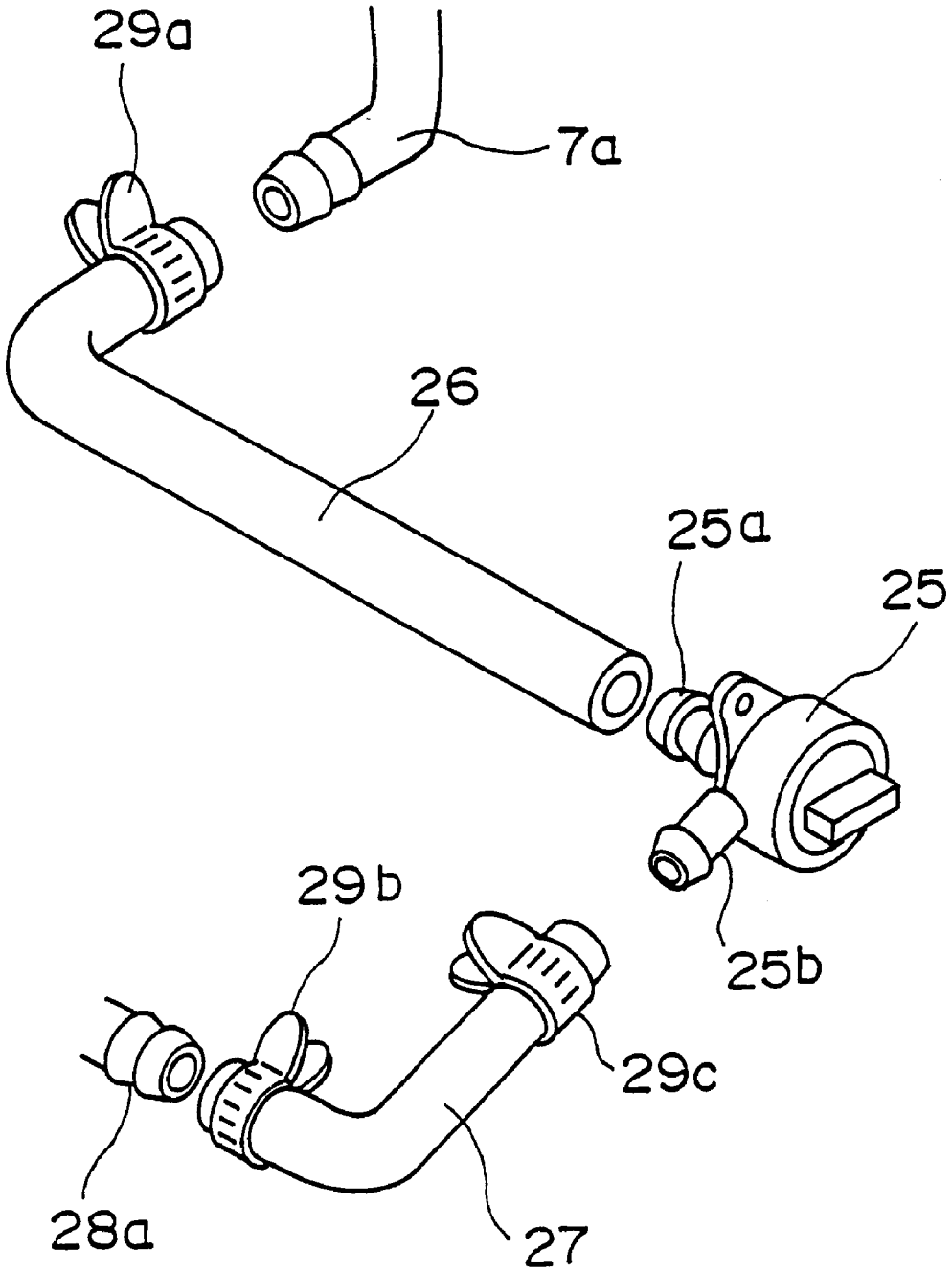
FIG. 3 is a perspective view of the essential parts of the fuel line.
Figure 4:
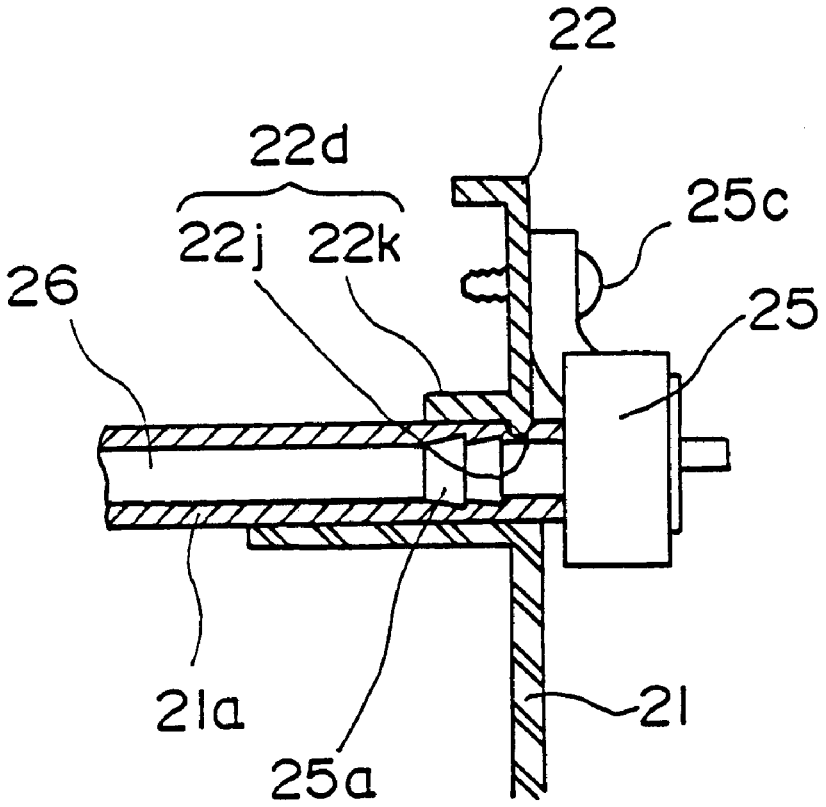
FIG. 4 is a cross section of the area where the fuel cock is mounted.

FIG. 1 is a perspective drawing showing the essential components in the vicinity where the fuel line and front cover are mounted on a small, multi-purpose, canted cylinder, type single-cylinder engine which is a preferred embodiment of this invention. FIG. 2 is a perspective drawing of the essential parts of the fan cover and front cover. FIG. 3 is a perspective drawing of the essential parts of the fuel line. FIG. 4 is a cross section of the area where the fuel cock is mounted.

Figure 5:
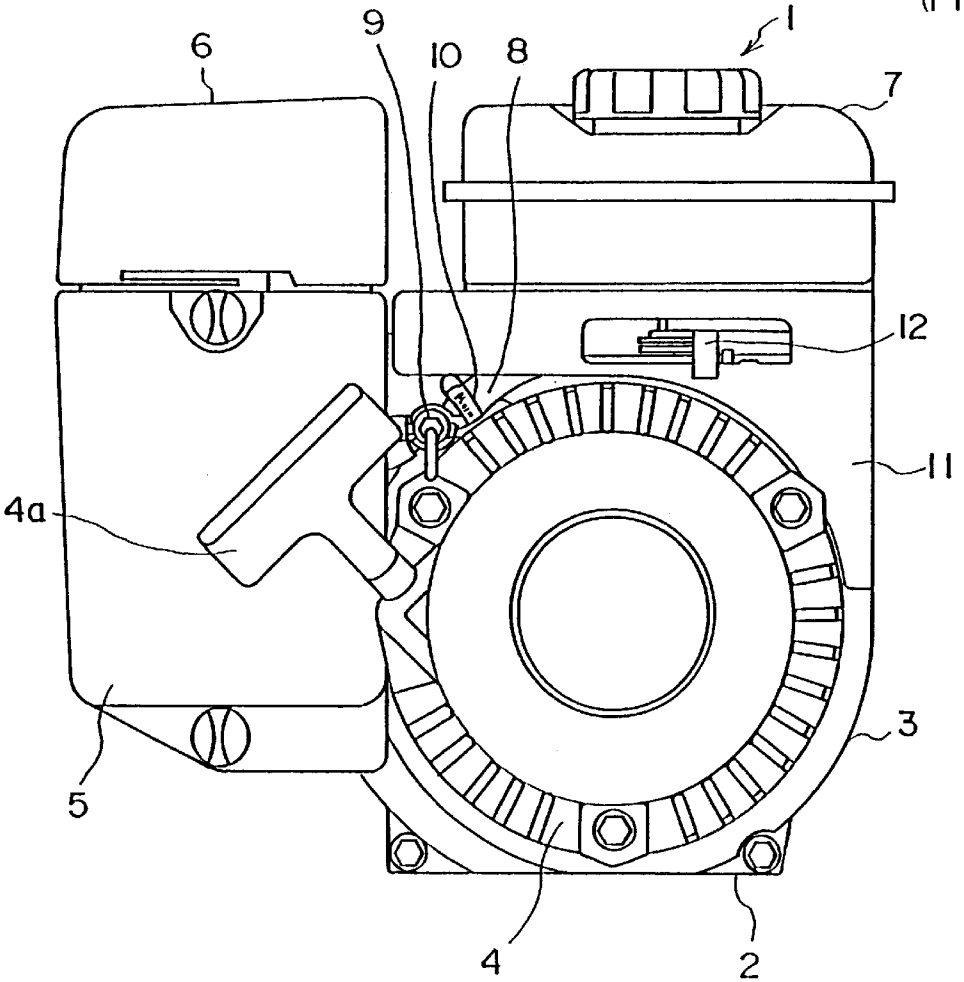
Fig. 5 (PRIOR ART)
FIG. 5 is a front view of a canted cylinder-type single cylinder multi-purpose engine belonging to the prior art, which represents the sort of engine in which this invention may be implemented.
Figure 6:
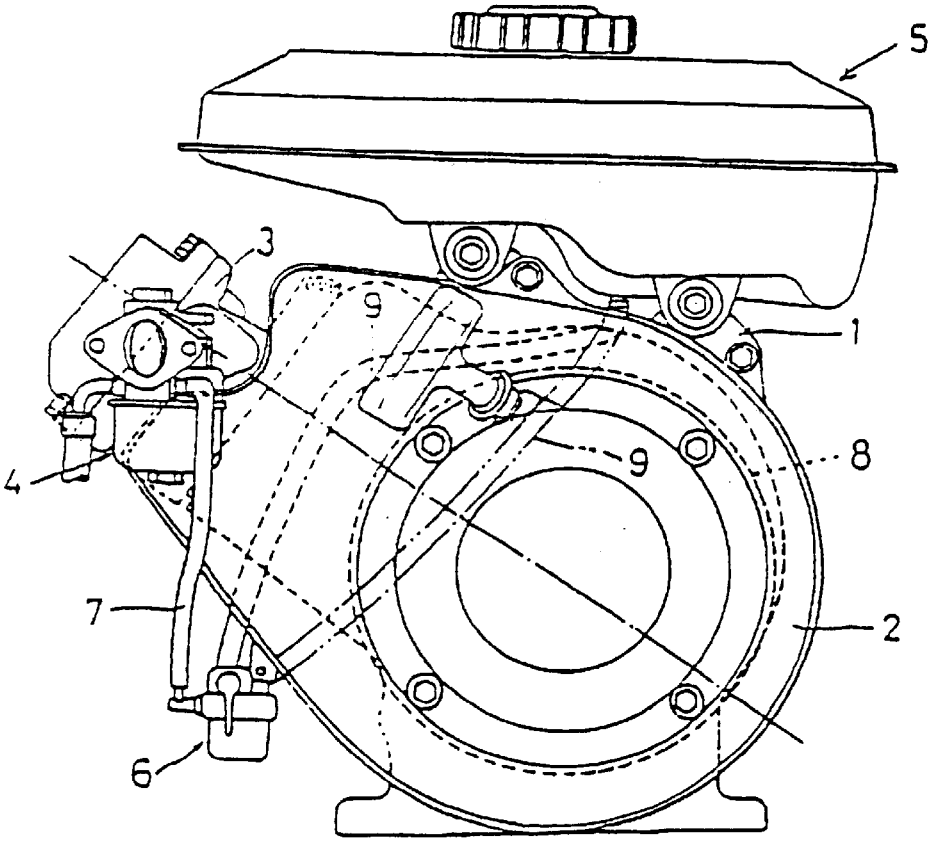
FIG. 6 is a front view of a canted cylinder-type single cylinder multi-purpose engine shown in published Japanese Utility Model Showa 64-47976.

In FIG. 1, 21 is the fan cover, which is fixed to the front of engine body 2. (See FIG. 5.) 22 is the front cover, which is installed on top of the fan cover 21. The lower end of the front cover engages the fan cover 21. The upper end is bolted to a device which shall be discussed shortly. 23 is the case for the recoil starter, which is fixed to the front of the fan cover 21. Starter grip 24 is held inside the case in such a way that it can be drawn out freely. 25 is the fuel cock, which is bolted to the front of the front cover 22. Fuel lines 26 and 27 are connected to the front and back of the fuel cock 25. The other end of fuel line 26, the tube going to the inlet side of the cock 25, is connected to outlet 7*a* of fuel tank 7, which can be seen in FIG. 5. The other end of fuel line 27, the tube going to the discharge side of the cock 25, is connected to inlet 28*a* of carburetor 28.

In FIG. 2, 21*a* is a semicircular groove which immobilizes the fuel line 26. It runs across the top of the fan cover 21 where it is closer to the carburetor 28 side. Flange 21*d*, which is formed on the left side of the groove 21*a* which is close to the carburetor, has a hole 21*b* in it through which front cover 22 can be bolted to the engine. A number of holes 21*c* are provided in the rear surface of the flange 21*d* through which the fan cover can be bolted to engine body 2. (See FIG. 5.)

Horizontal surface 22*a*, which is shaped like an angular letter "C", is formed on the upper surface of the front cover 22. This surface is attached to the bottom of the fuel tank 7 with a specified clearance between the two. The lower surface of front cover 22, which comprises horizontal surface 22*b* and curved surface 22*c*, engages the fan cover 21. The horizontal surface 22*b* has a semicircular groove 22*d* in it to immobilize fuel line 26. As can be seen in FIG. 4, the groove 22*d* comprises tooth 22*j* and straight segment 22*k*. In the front surface of the front cover 22 are found hole 22*e*, which is used for a screw to attach the fuel cock 25; hole 22*f*, which is used for a bolt to attach fan cover 21; and rectangular aperture 22*g*, which accommodates the throttle lever.

The configuration of the entire system of tubes which includes the fuel lines 26 and 27 and fuel cock 25 is shown in FIG. 3. In the drawing, one end of the fuel line 26 is inserted into L-shaped fuel outlet 7*a* on the bottom of fuel tank 7 and held in place by a clamp 29*a*. The other end of the fuel line 26 is inserted into inlet connector 25*a* of fuel cock 25.

One end of the fuel line 27 is inserted into outlet connector 25*b* of the fuel cock 25 and held in place by a clamp 29*c*. The other end of fuel line 26 is inserted into inlet connector 28*a* of carburetor 28 and held in place by clamp 29*b*.

When this configuration of fuel lines is mounted on the engine, as can be seen in FIGS. 2 and 4, the periphery of fuel line 26 is fitted into groove 22*d* in front cover 22. The end of fuel line 26 is inserted into fuel cock 25, and the fuel cock is fixed to the front cover 22 by bolt 25*c*. When fuel cock 25 has been bolted to front cover 22, it is fitted together with fan cover 21. When semicircular groove 22*d* in front cover 22 and semicircular groove 21*a* in fan cover 21 are put together and fixed in place, fuel line 26 is locked in groove 21*a*. In this way fuel line 26 is prevented from moving to the left or right, and the end of the fuel line 26 is fixed to connector 25*a* of fuel cock 25. As can be seen in FIG. 4, the bottom half of fuel line 26 fits into and is supported by groove 21*a* in fan cover 21. The top half of fuel line 26 engages with groove 22*d* in front cover 22. Tooth 22*j* in groove 22*d* engages a narrow portion of connector 25*a* of fuel cock 25 to hold the fuel line in place.

Fuel cock 25 is fixed to front cover 22 by tightening bolt 25*c*. When the periphery of the tooth 22*j* engages the narrow portion of connector 25*a* of fuel cock 25, fuel line 26 is firmly locked in place and cannot get loose.

If an orthogonal-type fuel cock 25 is attached to front cover 22 on an angle, it will be even easier to connect fuel line 27 to carburetor 28.

As discussed above, in this embodiment fuel line 26 is sandwiched between groove 22*d* in front cover 22 and groove 21*a* in fan cover 21, and fuel cock 25 is fixed to front cover 22. When front cover 22 is mounted to fan cover 21, the fuel line 26 is held in place and prevented from moving to the left or right. Fuel lines 26 and 27 are positioned reliably and fixed in place without any need for extra clamps and/or associated hardware.

Because fuel cock 25 is fixed to the front surface of front cover 22, the process of mounting the cock 25 is made much easier. And because it is easier to operate the fuel cock 25, the operability of the engine also is improved. With this invention, as has been described above, the fuel line is sandwiched in place between two semicircular grooves, one in the fan cover and the other in the front cover, and the fuel cock is fixed to the front cover. Thus, by modifying the shape of certain portions of the fan cover and front cover as they existed in the prior art, a configuration has been achieved in which the fuel line with the cock fixed to it can be reliably fixed to the engine without the use of clamps and their attendant hardware. In this way the following benefits are realized:

(1) The elimination of the clamps and other hardware formerly used to attach the fuel line to the engine lowers the cost;

(2) Fixing the fuel cock to the front cover improves the ease with which the engine can be assembled and operated; and (3) Fixing the fuel line and cock to the engine body by sandwiching the fuel line between the fan cover and front cover improves the safety and quality of the engine.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variants falling within the scope of the appended claims and equivalents thereof.

What is claimed is:

1. A single-cylinder multi-purpose engine comprising:

a fan cover fixed on a front of said engine;

a front cover fixed on top of said fan cover; and a fuel line having a fuel cock and connected between a fuel tank fixed on an upper portion of said engine and a carburetor fixed on a side of said engine;

said fan cover and said front cover each having a semicircular groove formed therein, and said fuel line being received in the semicircular grooves and sandwiched between said fan cover and said front cover.

2. A single-cylinder multi-purpose engine according to claim 1, wherein said fuel cock is fixed to said front cover, and an end of said fuel line is engaged with an outer periphery of a connector of said fuel cock and is sandwiched and held fast between the semicircular groove on said fan cover and the semicircular groove on said front cover.

3. A single-cylinder multi-purpose engine according to claim 2, wherein said semicircular groove is provided with a tooth on an inner peripheral surface of the groove, and said tooth engages a narrowed portion of the connector of said fuel cock and thereby immobilizes the fuel line.

* * * * *